United States Patent [19]

Sakai et al.

[11] Patent Number: 5,030,116

[45] Date of Patent: Jul. 9, 1991

[54] CONNECTOR BLOCK FOR INJECTORS FOR INTERNAL COMBUSTION ENGINE AND JUNCTION TERMINAL FOR USE WITH THE SAME CONNECTOR BLOCK

[75] Inventors: Tatsuo Sakai, Kariya; Mitsuhiro Fujitani; Yasuo Matsushita, both of Yokkaichi; Akira Nabeshima, Mie, all of Japan

[73] Assignees: Sumitomo Wiring System, Ltd.; Nippondenso Co., Ltd., both of Japan

[21] Appl. No.: 575,147

[22] Filed: Aug. 29, 1990

[30] Foreign Application Priority Data

Sep. 4, 1989 [JP] Japan ..... 1-103805[U]
Nov. 24, 1989 [JP] Japan ..... 1-136679[U]

[51] Int. Cl.[5] ..... H01R 23/02

[52] U.S. Cl. ..... 439/130; 439/652; 123/456; 123/470

[58] Field of Search ..... 439/130, 34, 552, 505, 439/652, 654, 214–216, 606, 638, 639, 207, 209, 211; 123/456, 470, 472

[56] References Cited

U.S. PATENT DOCUMENTS

| | | | |
|---|---|---|---|
| 4,453,792 | 6/1984 | Bright et al. | 439/251 |
| 4,844,036 | 7/1989 | Bassler et al. | 123/470 |
| 4,857,003 | 8/1989 | Hafner et al. | 439/505 |
| 4,950,171 | 8/1990 | Muzslay | 439/76 |

*Primary Examiner*—Gary F. Paumen
*Attorney, Agent, or Firm*—Jordan B. Bierman

[57] ABSTRACT

A connector block for injectors for an internal combustion engine comprises a rod-like main stem section of a heat-resistant rigid resin having a connector portion for a wire harness and a required number of injector connecting portions disposed at predetermined intervals that are molded as integral parts thereof, and tab-like terminals are made exposed from the connector portion for a wire harness and the injector connecting portions, and bus bars are insert molded in the rod-like main stem section for effecting an electrical connection between the connector portion and injector connecting portions, whereby an electrical connection is effected between a wire harness and a group of injectors. A receptacle junction terminal having upper and lower contact sections in which tab-like terminals are inserted for connection and adapted to be accommodated in a terminal accommodating chamber of the connector block is made by blanking a single plate material into a predetermined configuration and holding the plate material so blanked into a hollow quadrilateral prism, and at least a pair of cantilever-like elastic pieces are formed, respectively, on front and back walls of said quadrilateral prism in such a manner as to protrude upwardly therefrom, and the terminal accommodating chamber accommodates the junction terminal with the top portions of the elastic pieces of the junction terminal being in press contact therewith, while a space where the elastic pieces are allowed to be elastically flexible is being provided between the inner walls of the terminal accommodating chamber and the front and back walls of the junction terminal, respectively.

6 Claims, 8 Drawing Sheets

CONNECTOR BLOCK FOR INJECTORS FOR INTERNAL COMBUSTION ENGINE AND JUNCTION TERMINAL FOR USE WITH THE SAME CONNECTOR BLOCK

BACKGROUND OF THE INVENTION

1. Field of the Invention

The present invention relates to a connector block for effecting an electrical connection between injectors (fuel injecting instrument) for a fuel injection device for an internal combustion engine for an automotive vehicle or the like through which fuel is injected and a power source for operating the injectors, and also relates to an improved receptacle junction terminal adapted to be accommodated in a terminal accommodating chamber of the connector block for relaying electricity by receiving therein tab-like male terminals from the respective ends thereof.

2. Statement of the Prior Art

An electrical connection between injectors for an internal combustion engine for an automotive vehicles or the like and a power source for operating those injectors is effected through a wiring system in which a main wire harness is laid out close to a fuel injection device having a multiplicity of injectors arranged herein, in which the main wire harness and the individual injectors are connected each other via groups of branched electrical wires connected to double-ended connectors, and in which the heat resistance of the groups of electrical wires are attained by covering each group of electrical wires with a heat-resistant tube.

However, this type of conventional electricity connecting structure has the following drawbacks:

(i) since connectors and electrical wires are subjected to a high-temperature atmosphere and strong vibrations, the above connecting structure cannot meet the standard of resistance to vibrations and heat required for such an application, and therefore disconnection or heat deterioration cannot be avoided, resulting in poor reliability in quality in relation to resistance to vibrations and haet;

(ii) since individual injectors are connected to a main wire harness via individual branched wires, the number of components required for effecting an electrical connection has to be increased, resulting in an increase of manufacturing costs, and moreover, a complicated connecting operation is required, and this often causes electricity-connecting errors due to a mistake of simply forgetting to connect wires at connectors and/or deformation and/or breakage of connectors and so forth;

(iii) since not only a special consideration needs to be taken for the lay-out of wires but also the wires need to be covered with heat-resistant tubes with a view to eliminating as much as possible a risk of wires being broken or heat-deteriorated, no good efficiency in molding and laying out groups of wires cannot be expected; and (iv) good visual configuration of laid-out wires cannot be expected, and therefore superior functional beauty of a wiring cannot be expected.

In addition, other examples of conventional receptacle junction terminals of this type for use with a connector block for injectors for an internal combustion engine are shown in FIGS. 5 and 6. FIG. 5 is a side view of one of the examples in which the basic structure of a junction terminal 203 is shown. FIG. 6(A) is a side view of a conventional junction terminal 303 of another type, and FIG. 6(B) is an exploded perspective view of FIG. 6(A).

According to its basic structure, the receptacle junction terminal 203 shown in FIG. 5 is inserted into a terminal accommodating chamber 11 of a connector block 1 so as to be accommodated therein, and receives, for example, a tab terminal 205A on the side of a connector and a tab terminal 205B on the side of an instrument from the respective ends thereof so that the terminals are securely inserted into contact sections 206 formed at the respective ends thereof for effecting an electrical connection. However, since this junction terminal 203 is inserted and accommodated in the terminal accommodating chamber 11 without any "play", when the tab terminal 205B on the side of an instrument is inserted into the junction terminal 203 accommodated in the terminal accommodating chamber 11 from the outside of the connector block 1 with a deviation E being present due to the deviation of the thickness-wise center line 219 of the tab terminal 205B relative to the center line 207 of the contact section 206 along which the tab terminal 205B is inserted, the resistance to the tab terminal 205B being inserted increases, resulting in poor workability. If the tab terminal 205B continues to be forcibly inserted irrespective of the resistance, the contact section 206 is then plastically deformed, and this causes a problem in which the electricity connecting performance of the junction terminal decreases.

The junction terminal shown in FIGS. 6(A), 6(B) is disclosed in U.S. Pat. No. 4,453,792 and was devised to solve the above problem. As shown in the drawings, this junction terminal of the U.S. patent comprises a pair of blade members 320A, 320B that are overlapped each other to form a contact section and a pair of spring members 321A, 321B that are placed on the left- and right-hand side edges of the pair of overlapped blade members 320A, 320B in such a manner as to hold the blade members from both sides. Thus, these four members are assembled to a receptacle junction terminal 303, and the receptacle junction terminal so assembled is accommodated in a terminal accommodating chamber 11 in such a manner that the elastic displacement thereof is allowed. In this construction, even if the center of the tab terminals 305 received in the receptacle junction terminal from the respective ends thereof deviates from the corresponding contact sections 306, the elastic displacement of the spring members 321A, 321B facilitates the insertion of the tab terminals 306.

Although this junction terminal according to the U.S. patent is superior in securely inserting the tab terminals 305 into the contact sections 306, it has the following drawbacks that affect its utility:

since it comprises four members, the number of components increases, and assembly work is needed, resulting in increase in manufacturing costs;

the structure is complicated, resulting in poor workability; and the terminal accommodating chamber needs to be made such that the ends thereof are closed in order to stabilize the posture of the junction terminal when accommodated in the terminal accommodating chamber, a special locking means being thus required.

SUMMARY OF THE INVENTION

An object of the present invention is to provide a connector block for injectors for an internal combustion engine in which the quality and performance thereof as a means for effecting an electrical connection so as to operate a group of injectors is improved by securing required physical properties such a heat resistance, vibration resistance and so forth, in which the efficiency in disposing the means for effecting an electrical connection is improved, while the manufacturing costs are decreased, and in which the functional beauty of the means so disposed is also improved.

Another object of the present invention is to provide a junction terminal for use with the above connector block that facilitates a tab terminal insertion, which is formed from a single plate material, resulting in a simple construction, which is superior in workability and manufacturing costs, and which has lots of utility.

A connector block for injectors for an internal combustion engine according to the present invention was devised to accomplish the above objects and comprises a connector section for a wire harness, a rod-like main stem section having the predetermined number of injector connecting portions formed integrally therewith at predetermined intervals, tab-like terminals made exposed at the connector section for a wire harness and the injector connecting portions and bus bars insert molded in the rod-like main stem section for electrically connecting the connector section for a wire harness to the injector connecting portions, wherein an electrical connection is effected so as to operate a group of injectors by connecting the connector section for a wire harness to a wire harness, while the injector connecting portions are collectively connected to the group of injectors.

In the connector block for injectors according to the present invention constructed as described above, since bus bars insert molded in the main stem section formed from a heat-resistant rigid resin is used as a means for effecting an electrical connection between a wire harness disposed adjacent to an engine and the group of injectors, the electricity-connecting structure comprises a rigid integrally constructed body constituted by a heat-resistant rigid resin in which a metal plate is molded, and therefore, compared with the conventional electricity-connecting structure, required physical properties such as heat resistance, vibration resistance and so forth are secured to a sufficient extent. In addition, the rigid integrally constructed body of connector block for injectors can be collectively connected to the group of injectors, and moreover, since the connector block of the present invention can thus be made as a single construction, the functional beauty thereof as an electricity-connecting construction can also be improved.

In addition, a junction terminal according to the present invention adapted to be suitably used with the above connector block is characterized by a receptacle junction terminal having contact sections in which tab terminals are inserted for electrical connection formed at the upper and lower portions thereof, respectively, and adapted to be accommodated in the terminal accommodating chamber of the connector block. This receptacle junction terminal is made by blanking a single plate material into a predetermined configuration, and then folding the plate material so blanked into a quadrilateral prism, and at least a pair of cantilever-like elastic pieces are formed, respectively, on the front and back walls of the quadrilateral prism in such a manner as to protrude therefrom. These cantilever-like elastic pieces are brought into press contact with the walls of the above terminal accommodating chamber at the top thereof when the receptacle junction terminal so formed is accommodated in the terminal accommodating chamber with a space where the elastic pieces are allowed to be flexible in an elastic fashion being provided between the internal circumferential walls of the terminal accommodating chamber and the front and back walls of the receptacle junction terminals, respectively, whereby the junction terminal can be securely inserted and locked in the terminal accommodating chamber in such a manner that the elastic displacement of the terminal is allowed.

Embodiments of the receptacle junction terminal as described above are as follows:

(i) the elastic pieces to be formed on the front and back walls of the junction terminal are arranged such that the respective pairs of the elastic pieces cross each other in an X-shaped fashion; and (ii) a fitting means is provided which comprises a locking portion comprising, in turn, a U-shaped groove provided between the respective pairs of elastic pieces in such a manner as to extend in parallel to the transverse center line of the front and back walls of the junction terminal, and elongated locking projections provided on the internal walls of the terminal accommodating chamber in such a manner as to fit in the corresponding locking portions.

The junction terminal constructed as described above according to the present invention has at least four cantilever-like elastic pieces disposed on the front and back walls of the main body in such a manner as to outwardly protrude therefrom, and the elastic pieces are brought into press contact with the inner walls of the terminal accommodating chamber with a space where the elastic pieces are allowed to be flexible in an elastic fashion being provided therebetween when the junction terminal is accommodated in the terminal accommodating chamber, thereby making it possible for the junction terminal to be accommodated in the terminal accommodating chamber in such a manner that the elastic displacement of the terminal is allowed. Due to this, the posture of the junction terminal inserted in the terminal accommodating chamber is locked by the press contacting force of the elastic pieces, and even if there is a slight positional deviation of tab terminals to be securely inserted, the junction terminal in the terminal accommodating chamber is elastically displaced without any difficulty so as to receive the tab terminals therein for effecting a smooth electrical connection. In addition, the junction terminal of the present invention is made by folding a single plate material blanked into a predetermined configuration, and this serves to make the construction of the junction terminal simple and therefore the junction terminal is easy to be constructed, the necessity of assembly work being thus obviated.

Furthermore, as described in the embodiments of the junction terminal according to the present invention, arranging the respective pairs of elastic pieces such that they cross each other in an X-shaped fashion serves to balance the press contacting force, thereby making it possible to further stabilize the posture of the junction terminal inserted into the terminal accommodating chamber. In addition, utilizing the fitting means comprising the locking portion formed between the respective pairs of elastic pieces and the elongated locking projections on the side of the terminal accommodating chamber serves to improve the feeling felt when the junction terminal is securely inserted in the terminal accommodating chamber, since a snapping sound is heard when the fitting means properly works.

DETAILED DESCRIPTION OF THE PREFERRED EMBODIMENTS:

Referring to FIGS. 1 to 4, embodiments of a connector block for injectors for an internal combustion engine and a junction terminal adapted to be accommodated in a terminal accommodating chamber of the connector block both according to the present invention will now be described.

Figure 1A:
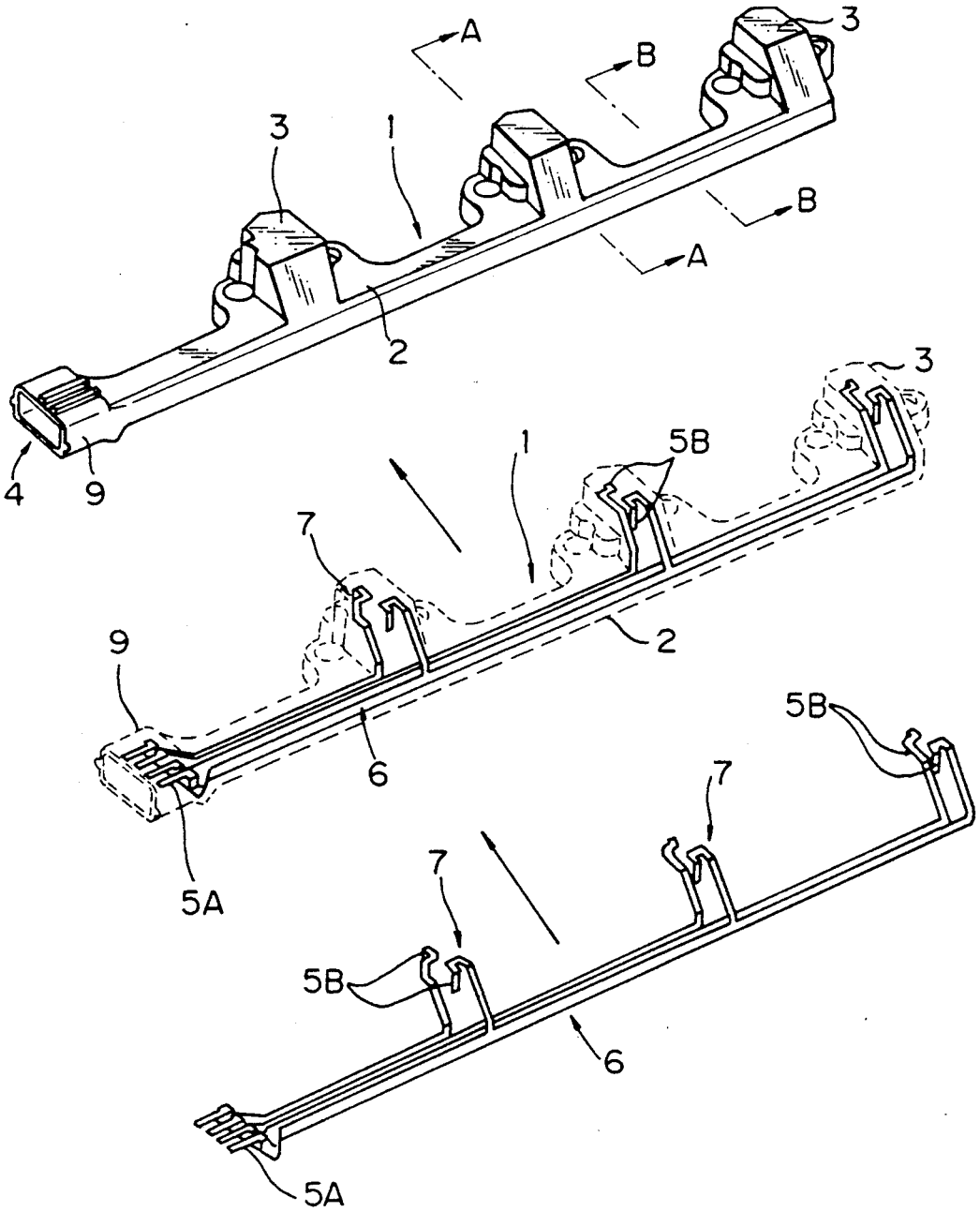
FIGS. 1(A) to 1(D) show one embodiment of a connector block for injectors according to the present invention, FIG. 1(A) being a perspective view showing bus bars as constituting components of the connector block and the whole body thereof, FIG. 1(B) being a cross-sectional view taken along the line A—A of FIG. 1(A), FIG. 1(C) being a cross-sectional view taken along the line B—B of FIG. 1(A), and FIG. 1(D) being a perspective view of a junction terminal to be securely inserted into an injector connecting portion of the connector block.
Figure 1B:
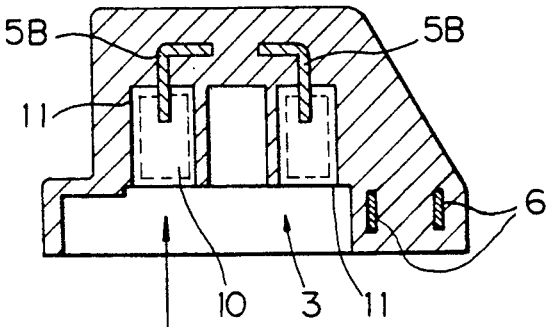
Figure 1C:
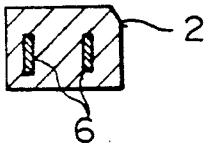

Referring to FIGS. 1(A) to 1(D) showing one embodiment of the present invention applied to injectors for an engine for an automotive vehicle, in a connector block 1 for injectors according to the present invention (hereinafter, referred to simply as connector block 1), as shown in FIG. 1(A), the required number of injector connecting portions 3 are formed at predetermined intervals on a rod-like main stem section 2 formed from a heat resistant rigid resin and having a connector 4 for a wire harness integrally formed at one end thereof. Bus bars 6 are insert molded in the main stem section 2 in such a manner that tab-like terminals 5A and 5B are made exposed at the connector 4 for a wire harness and the group of injector connecting portions 3, respectively, and the connector block 1 constructed as described above serves to connect a main wire harness to the group of injectors of an engine in a collective fashion for electrical connection.

To be precise, the bus bars 6 are provided with the required number of intermediate connecting portions 7 (three being diagramatically represented) disposed at predetermined intervals in accordance with the lay-out of injectors of the engine, and the tab-like terminals 5A for a connector for a wire harness are provided at the leading end of the bus bars 6 in such a manner as to project therefrom, while the tab-like terminals 5B are provided in such a manner as to branch off upwardly from the bus bars 6 so as to be connected to the corresponding intermediate portions 7. The whole of bus bars 6 except these tab-like terminals 5A and 5B are insert-molded in a heat resistant reinforced rigid resin (a "polyethylene terephthalate" containing 30% of glass fibers is used in the present invention) so as to form a rigid integral construction.

The tab-like terminals 5A provided in such a manner as to project from one end of the rigid integral construction are accommodated in a male type connector housing 9 formed at the end of the main stem section 2 as an integral part thereof, and constitute the connector 4 for a wire harness together with the connector housing 9. The tab-like terminals 5B branching off upwardly at intermediate positions along the length of the main stem section 2 are made exposed from the inside of the center of the respective injector connecting portions 3 that are formed as an integral part of the main stem section 2 in such a manner as to expand sidewardly thereof so as to form a cap-like portion the bottom of which is made open, and these tab-like terminals are securely arranged in such a manner as to face downwardly.

Figure 1D:
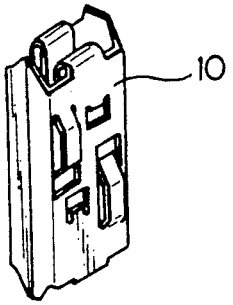

Thus, the tab-like terminals 5B inside the injector connecting portions 3 are caused to project downwardly so as to be made exposed in the upper portion of a junction terminal accommodating chamber 11, and a junction terminal 10 shown in FIG. 1(D) as having receptacle contact sections at the both ends thereof is securely inserted in this junction terminal accommodating chamber 11, and one end of the junction terminal 10 is connected to the tab-like terminals 5B, while the other end thereof is connected to tab-like terminals 5C (FIG. 2) provided on an injector 8 (FIG. 2) in such a manner as to upwardly project therefrom. A description of this junction terminal 10 will be made later on.

Figure 2:
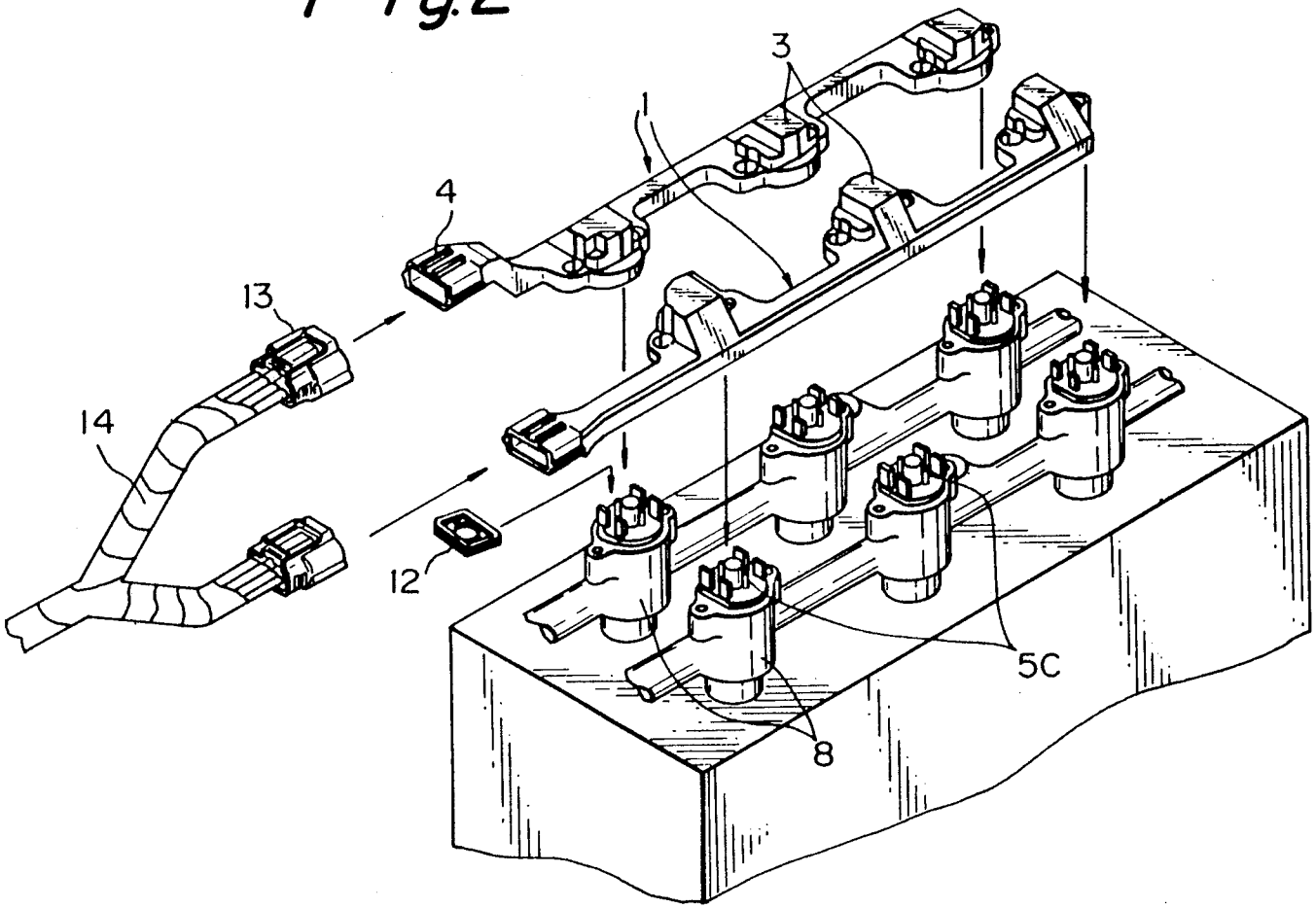
FIG. 2 is a perspective view showing a state in which the connector blocks according to the present invention are being used.

As shown in FIG. 2, in the connector block 1 as described above, the injector connecting portions 3 are collectively placed over a group of injectors 8 so that the tab-like terminals 5B of the bus bars 6 and the tab-like terminals 5C of the injectors 8 are electrically connected to each other, while the connector 4 for a wire harness is connected to a connector 13 of a main wire harness 14 that is laid out adjacent to the engine, an electrical connection between the injectors 8 and a power source for opeating the same being thus effected. A water-proof packing 12 is mounted on the joint portion where the injector connecting portion 3 and the injector 8 are jointed together.

With the embodiment of the connector block 1 constructed as described above, since the metal bus bars 6 molded in the main stem section 2 formed from a heat resistant reinforced rigid resin is bridged between the connector 13 of the main wire harness 14 and the group of injectors 8 for effecting an electrical connection, the heat and vibration resistance of the connector block 1 is sufficiently secured, thereby making it possible to solve the problems of quality attributed to vibrations and/or heat deterioration inherent in the conventional connector block.

In addition, since the connector block of rigid integral construction can be collectively connected to a group of injectors, compared with a conventional construction in which connectors are connected to individual injectors, the efficiency of connecting work can be improved. Moreover, a careless mistake of forgetting to connect a connector to an injector can be prevented, and the deformation and/or breakage of the connecting portions or the like can also be prevented.

Moreover, since the connector block of the present invention is made as a rigid integral construction, the number of constituent components can be decreased, resulting in a simple construction, and the reliability in the quality of the rigid integral connector block as an electricity connecting means can be improved, while the decrease of manufacturing cost is promoted. Lastly, the functional beauty of the electricity connecting mechanism can also be improved.

Next, an embodiment of a junction terminal according to the present invention that is suitable for use with the above-mentioned connector block 1 will now be described. Referring to FIGS. 3 and 4, a receptacle junction terminal 10 according to the present invention is made by blanking a single plate material into a predetermined configuration [FIG. 3(F)] and then folding the plate material so blanked rectangularly so as to form a hollow quadrilateral prism [FIG. 3(A)], and the upper and lower ends of the facing plate materials on the longer sides of the hollow quadrilateral prism are elongated in a belt-like fashion and the belt-like elongated portions are folded inwardly of the hollow portion 18 of the hollow quadrilateral prism so as to form a pair of upper and lower receptacle contact sections 16 in which tab terminals are received, respectively, for effecting an electrical connection. .

Figure 3A:
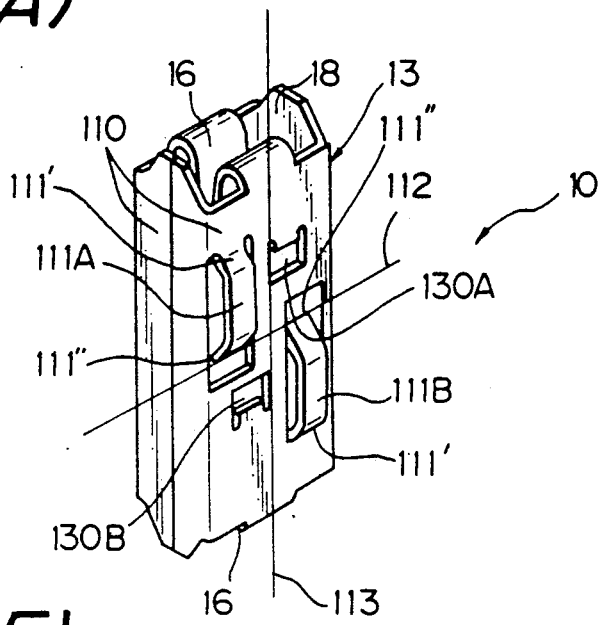
FIGS. 3(A) to 3(F) show a junction terminal according to the present invention that is suitable for use with the above connector block, FIG. 3(A) being a perspective view showing the same terminal, FIG. 3(B) being a front view of the junction terminal, and FIGS. 3(C), (D) (E), being back, bottom and side views of FIG. 3(B), respectively, and FIG. 3(F)
Figure 3F:
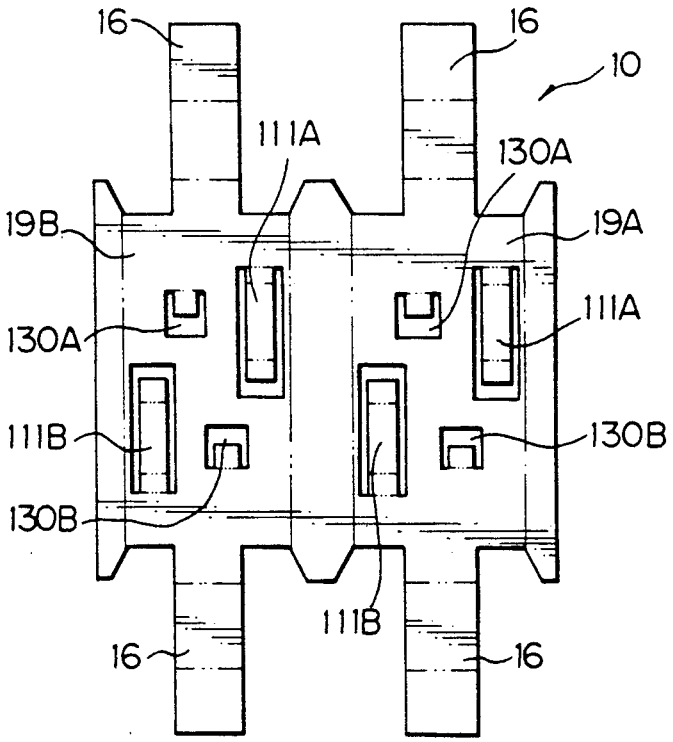
Figure 3B:
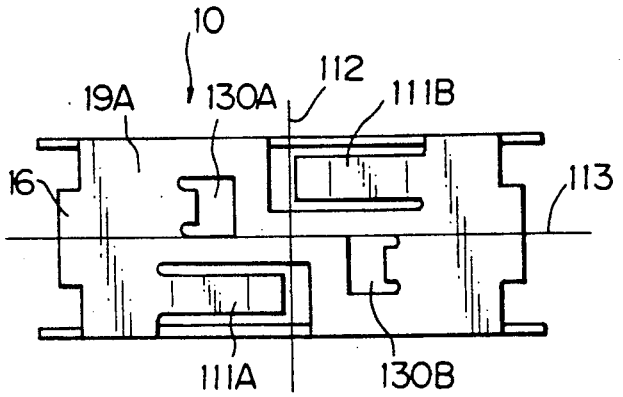
Figure 3C:
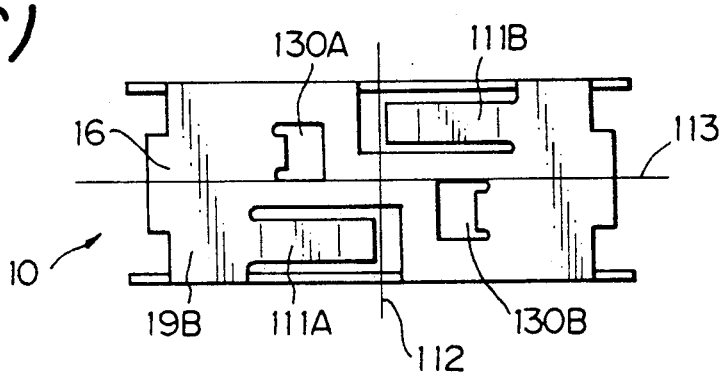
Figure 3D:
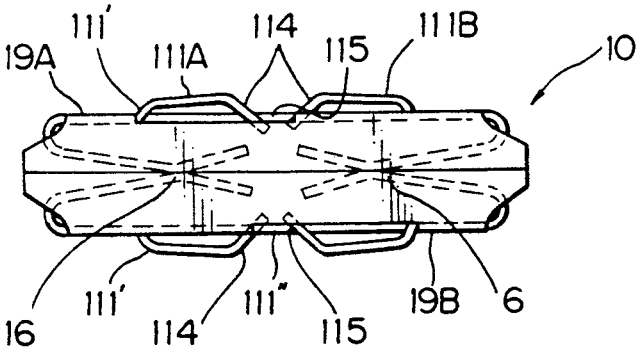
Figure 3E:
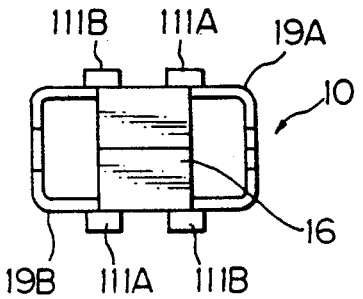

Cantilever-like elastic pieces 111A, 111B are formed, respectively, on a front wall 19A [FIG. 3(B)] and a back wall 19B [FIG. 3(C)] of the four walls 110 of the hollow quadrilateral prism by cutting the relevant walls 110 thereof and protruding the portions so cut outwardly into a trapezoidal shape. In other words, these elastic pieces 111A, 111B are elongated belt-like pieces intended to be brought into press contact with the inner circumferential walls 118 of the terminal accommodating chamber 11 when the junction terminal 10 is accommodated in the terminal accommodating chamber, whereby the junction terminal is elastically locked therein, and the wall 110 of the elastic pieces is outwardly protruded at the proximate end 111' thereof, while the free end 111" of the elastic piece is inclined inwardly, thereby forming a trapezoidal shape. Thus, the elastic pieces are shaped into cantilever-like plates that extend in parallel to the vertical center line of the front and back walls 19A, 19B.

A pair of elastic pieces 111A, 111B are disposed, respectively, on the front wall 19A and the back wall 19B such that they face each other diagonally at equal distances from the vertical and transverse center lines 113, 112 of the front and back walls, respectively, and these four elastic pieces 111A, 111B on the front and back walls 19A, 19B are arranged such that they cross each other in an X-shaped fashion.

Furthermore, the free ends 111" of the elastic pieces 111A, 111B on the front and back walls 19A, 19B are arranged such that they face the transverse center line 112 of the respective walls, and a slight gap is provided between the free ends 111" of the elastic pieces 111A, 111B with the transverse center line 112 acting as a center of the gap so provided. Thus, the sloping sides 114 formed at the free ends 111" of the respective elastic pieces 111A, 111B protruding upwardly from the wall 110 serve to form a locking portion 115 in which elongated locking projections 116A, 116B formed on the terminal accommodating chamber 11 are received, and these locking portion 115 and the elongated locking projections 116A, 116B constitute a fitting means for the junction terminal 10. A description of the elongated locking projections will be made later on.

As best shown in FIGS. 3(A), (B), (C) and (F), windows or openings 130A, 130B are provided in the front wall 19A and the back wall 19B, respectively, such that they face each other in a diagonal relation relative to the vertical center line 113 at an equal distance from the same The inner wall width W of the terminal accommodating chamber 11 of the connector block 1 in which the junction terminal 10 constructed as described are to be received is such that the four elastic pieces 111A, 111B which are in a free state are able to be received therein when they are slightly flexed and the elongated locking projections 116A, 116B that are to fit in the above-mentioned locking portions 115 are transversely provided in such a manner as to face each other on the inner walls 118 of the terminal accommodating chamber 11 that are brought into contact with the front and back walls 19A, 19B of the junction terminal 10 when it is accommodated therein.

Figure 4A:
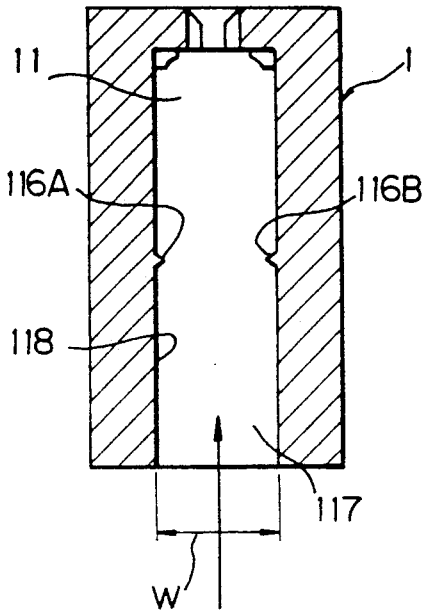
FIGS. 4(A) to 4(C) show one embodiment of the junction terminal and the terminal accommodating chamber according to the present invention, FIG. 4(A) being a side view showing the construction of the terminal accommodating chamber, FIG. 4(B) being a side view showing a state in which the junction terminal is being used, and FIG. 4(C) being a bottom view of FIG. 4(B)
Figure 4B:
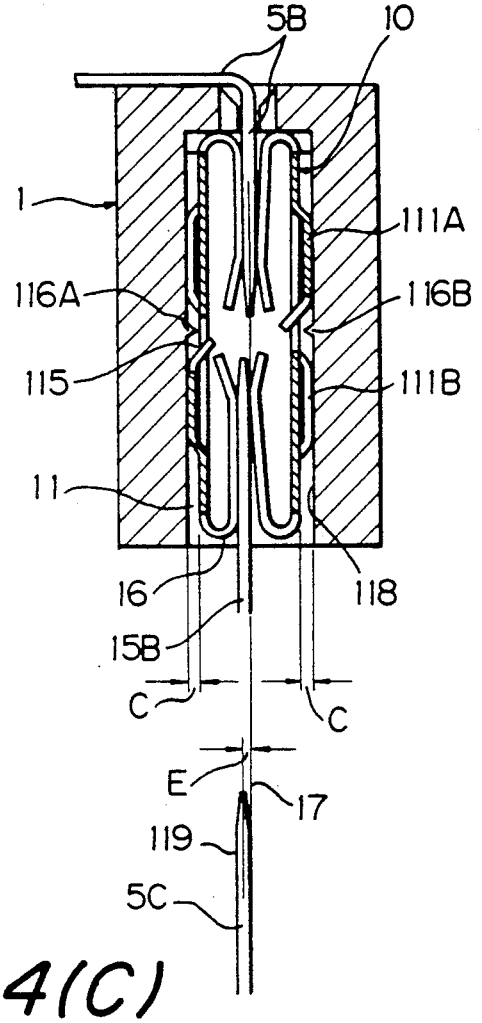
Figure 4B:
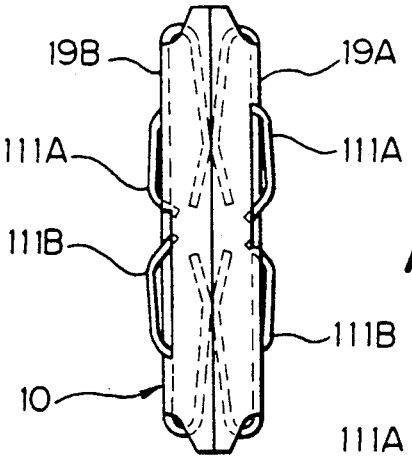
Figure 4C:
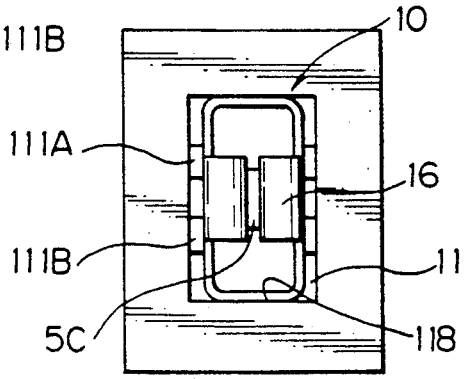
Figure 5:
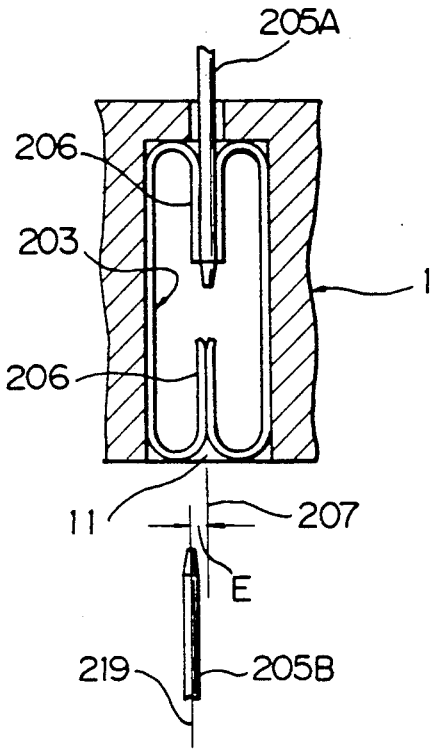
Fig.5 PRIOR ART
FIG. 5 is a side view showing the basic construction of a conventional junction terminal.
Figure 6A:
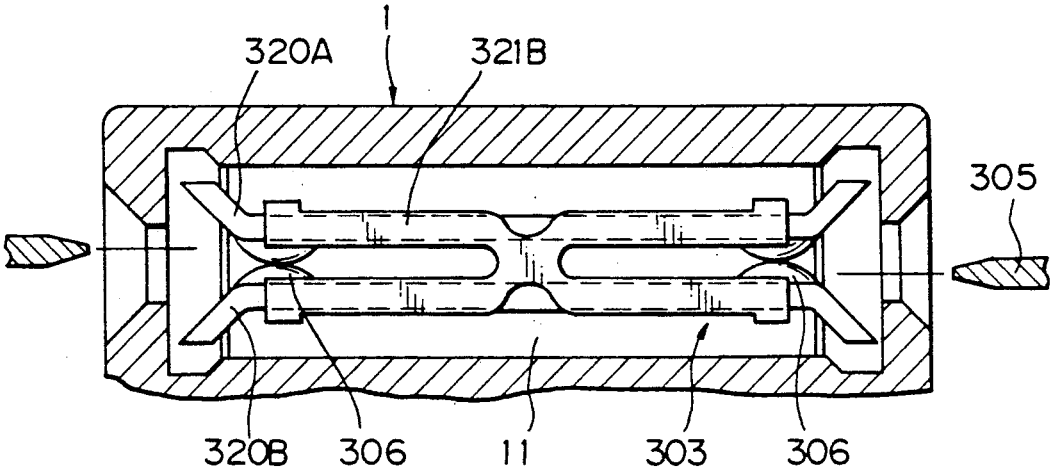
Fig.6(A) PRIOR ART
FIGS. 6(A) and 6(B) show a conventional junction terminal of another type, FIG. 6(A) being a side view showing a state in which the junction terminal is being securely inserted in an associated terminal accommodating chamber, and FIG. 6(B) being a perspective view showing constituent components thereof.
Figure 6B:
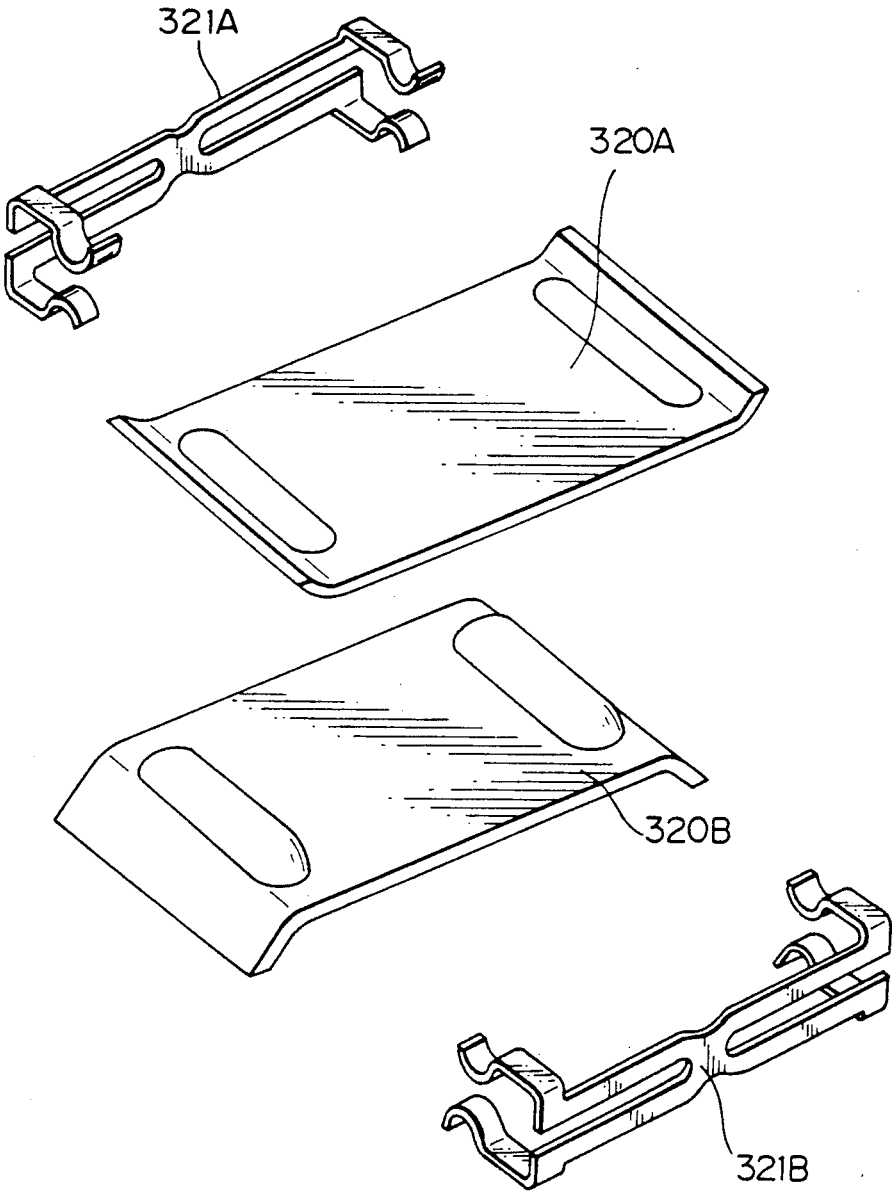
Fig.6(B) PRIOR ART

When the junction terminal 10 is inserted into the terminal accommodating chamber 11 from an opening 117 formed in the bottom thereof, the upper side portion of the respective trapezoidal elastic pieces 111A, 111B on the front and back walls 19A, 19B, i.e. the top portion of the elastic pieces 111A, 111B, are brought into contact with the inner walls 118 of the terminal accommodating chamber 11. Thus, the elastic pieces 111A, 111B are brought into press contact with the inner walls 118 of the terminal accommodating chamber 11 at this moment, and are elastically flexed slightly inwardly. When they are further pressed into the terminal accommodating chamber 11, the elastic pieces 111A that are located above the transverse center line 112 first come into contact with the elongated locking projections 116A, 116B, and are then elastically flexed inwardly by the insertion force so as to pass over the elongated locking projections 116A, 116B, whereupon the elongated locking projections 116A, 116B fit into their associated locking portions 115 with a snapping sound. Thus, as shown in FIG. 4(B), the junction terminal is securely inserted into the terminal accommodating chamber 11 to be locked at a predetermined position therein with a space C where the respective elastic pieces 111A, 111B are allowed to be elastically flexible being provided between the front and back walls 19A, 19B of the junction terminal 10 and the inner walls 118 of the terminal accommodating chamber 11. At this moment, the upper contact section 16 is connected to the tab-like terminal 5B on the side of the connector that protrudes into the terminal accommodating chamber 11, and after a proper time, the tab-like terminal 15C (FIG. 2) on the side of an instrument outside the connector block 1 is inserted into the lower contact section 16, whereby a pair of tab-like terminals 5A, 5C are electrically connected to each other. As shown in FIG. 4(C), the width-wise portions of the junction terminal 10 where the elastic pieces 111A, 111B are not present are designed to be brought into tight contact with the inner walls 118 of the terminal accommodating chamber 11 when the junction terminal 10 is inserted into the terminal accommodating chamber 11.

In the embodiment of the junction terminal 10 as described above referring to FIGS. 3 and 4, a pair of elastic pieces 111A, 111B are diagonally disposed, respectively, on the front and back walls 19A, 19B, and when looking at the whole of the junction terminal 10, these elastic pieces are arranged on the front and back walls 19A, 19B such that they cross each other in an X-shaped fashion. In this arrangement, since each elastic piece is designed to be brought into press contact with the inner wall 118 of the terminal accommodating chamber 11, press-contacting force is allowed to act on the inner walls 118 in a well-balanced manner, and this allows the junction terminal 10 to be securely inserted into the terminal accommodating chamber 11 and stably locked therein. In addition, since the elongated locking projections 116A, 116B fit into their associated locking portions 115 with a snapping sound when the junction terminal 10 has been inserted into the terminal accommodating chamber 11, a good insertion feeling can be felt.

Moreover, even if there is a positional deviation E due to the deviation between the thickness-wise center line 119 of the tab-like terminal 5C on the side of an instrument and the insertion center line 17 of the contact section 116 of the junction terminal 10, since the elastic pieces 111A, 111B are elastically displaced within the space C where they are allowed to be elastically flexible due to the insertion resistance generated by the insertion of the tab-like terminal 5C into the contact section 16 so that the insertion center line 17 comes into alignment with the tab-like terminal 5C, the insertion of the tab-like terminal 5C can be effected very easily, thereby making it possible to effect a smooth electrical connection.

In addition, since the junction terminal 10 is made by folding a single plate material [FIG. 3(F)], superior workability can be enjoyed, and no assembly work is needed.

Thus, the junction terminal of the present invention is advantageous in that it can be manufactured at lower costs and has superior utility.

Lastly, in the junction terminal 10 of the present invention, at least a pair of elastic pieces 111A, 111B may be provided, respectively, on the front and back walls 19A, 19B. However, in another embodiment of the junction terminal 10, four elastic pieces may be provided, respectively, on the front and back walls 19A, 19B in such a manner that they are arranged in an X-shaped fashion on each wall. This arrangement in which four elastic pieces are provided on each wall serves to further improve the locking stability of the junction terminal 10 when it is locked in the terminal accommodating chamber 11.

What is claimed is:

1. A connector block for injectors for an internal combustion engine comprising a rod-like main stem section of a heat-resistant rigid resin having a connector portion for a wire harness and a required number of injector connecting portions disposed at predetermined intervals that are molded as integral parts thereof, wherein tab-like terminals are exposed at said connector portion and said injector connecting portions, and wherein bus bars having said tab-like terminals are molded in said rod-like main stem section for effecting an electrical connection between said connector portion and injector connecting portions, whereby an electrical connection is effected between a wire harness and a group of injectors.

2. A connector block as set forth in claim 1, wherein a receptacle junction terminal having upper and lower contact sections in which tab-like terminals are inserted for connection is accommodated in a terminal accommodating chamber of a said injector connecting portion of said connector block, said junction terminal being made by blanking a single plate material into a predetermined configuration and folding said plate material so blanked into a hollow quadrilateral prism, having at least a pair of cantilever-like elastic pieces formed, respectively, on front and back walls of said quadrilateral prism in such a manner as to protrude upwardly therefrom, and said terminal accommodating chamber being designed to accommodate said junction terminal with the top portions of said elastic pieces of said junction terminal being in press contact therewith, while a space where said elastic pieces are allowed to be elastically flexible is provided between the inner walls of said terminal accommodating chamber and said front and back walls of said junction terminal, respectively.

3. A connector block as set forth in claim 2, wherein said elastic pieces formed, respectively, on said front and back walls of said junction terminal are arranged such that they cross each other in an X-shaped fashion.

4. A connector block as set forth in claim 2, wherein a locking portion is provided between said elastic pieces of said junction terminal in such a manner as to extend in parallel to a transverse center line of said front and back walls.

5. A connector block as set forth in claim 2, wherein windows are arranged on said front and back walls of said junction terminal such that they cross each other in an X-shaped fashion.

6. A connector block as set forth in claim 3, wherein a locking portion is provided between said elastic pieces of said junction terminal in such a manner as to extend in parallel to a transverse center line of said front and back walls.

* * * * *